US006860578B2

(12) United States Patent
Yamada et al.

(10) Patent No.: US 6,860,578 B2
(45) Date of Patent: Mar. 1, 2005

(54) APPARATUS AND METHOD FOR IMAGE PROCESSING, AND STORAGE MEDIUM

(75) Inventors: Akitoshi Yamada, Kanagawa (JP); Masao Kato, Kanagawa (JP); Mitsuhiro Ono, Tokyo (JP); Fumitaka Goto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/367,945

(22) Filed: Feb. 19, 2003

(65) Prior Publication Data

US 2003/0156151 A1 Aug. 21, 2003

(30) Foreign Application Priority Data

Feb. 21, 2002 (JP) ..... 2002-044809

(51) Int. Cl.[7] ..... B41J 29/393; B41J 2/21
(52) U.S. Cl. ..... 347/19; 347/43
(58) Field of Search ..... 347/19, 43, 15; 358/1.8, 1.1, 1.9, 515

(56) References Cited

U.S. PATENT DOCUMENTS 5,980,012 A 11/1999 Fujita et al.
6,390,583 B1 5/2002 Kato et al.
6,467,866 B1 * 10/2002 Nagoshi et al. ..... 347/15
6,505,909 B1 1/2003 Kato et al.
6,652,066 B2 * 11/2003 Teshigawara et al. ..... 347/41

* cited by examiner

*Primary Examiner*—Thinh Nguyen
(74) *Attorney, Agent, or Firm*—Fitzpatrick, Cella, Harper & Scinto

(57) ABSTRACT

When a plurality of sheets of images are laid out and outputted in one page and characteristic amounts of multi-valued image data are obtained to perform preferable image correction, the characteristic amounts of all the images to be recorded in the corresponding page have been beforehand obtained to calculate preferable image correction parameters. Therefore, a waiting time until the start of actual printing has been long. To resolve such an inconvenience, an image processing apparatus of the present invention includes a correction amount deciding unit for deciding or determining an individual correction amount with respect to each of the plurality of image data, and a correcting unit for correcting the image data based on the individual correction amount, whereby the correcting unit respectively corrects the images in accordance with the correction amounts which have already been decided, in a state where the correction amount deciding unit has not completed the decision of the correction amounts for all of the image data.

20 Claims, 10 Drawing Sheets

APPARATUS AND METHOD FOR IMAGE PROCESSING, AND STORAGE MEDIUM

BACKGROUND OF THE INVENTION

1. Field of the Invention

The present invention relates to an image processing apparatus for correcting a plurality of image data, an image processing method, and a storage medium.

2. Related Background Art

Conventionally, in order to obtain a characteristic amount of each multivalued image data to carry out suitable image correction when a plurality of images are laid out on one page and outputted, the characteristic amount of all the images to be recorded on a relevant page is obtained beforehand to calculate a suitable image correction parameter.

According to the conventional method, for example, in order to lay out eight images on one page and output the images, it is necessary to calculate a parameter by analyzing all the eight images before a start of actual printing. Thus, there are problems of a long waiting time until the start of actual printing, and a longer waiting time as the number of images laid out on one page is larger.

SUMMARY OF THE INVENTION

A feature of the present invention solves the aforementioned problems.

The present invention having the aforementioned feature provides an image processing apparatus comprising: correction amount deciding means for deciding an individual correction amount for each of a plurality of image data; and correcting means for correcting the image data based on the individual correction amount, wherein in an uncompleted state of deciding the correction amounts of all the plurality of image data by the correction amount deciding means, the correcting means executes correction for the image data based on the decided individual correction amount.

Other objects and features of the present invention will become apparent upon reading of the following preferred embodiments and drawings.

DETAILED DESCRIPTION OF THE PREFERRED EMBODIMENTS

First Embodiment

Next, a first embodiment of the present invention will be described. First, a photodirect (PD) printer to which the present invention can be applied will be described with reference to FIGS. 1 to 6.

Figure 1:
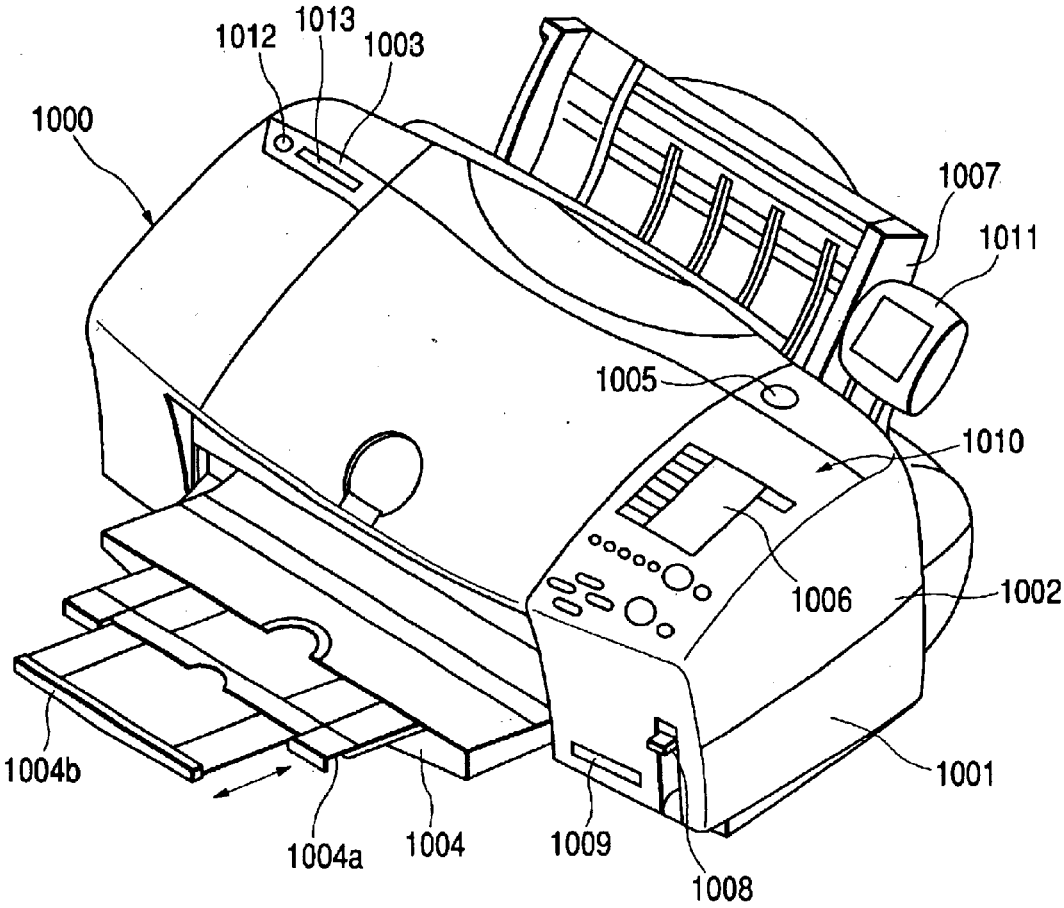
FIG. 1 is a schematic perspective view of a photodirect printer.

FIG. 1 is an appearance perspective view of a photodirect printer 1000 of the embodiment of the present invention. This photodirect printer is provided with a function as a normal PC printer for receiving data from a host computer (PC) to print it, and a function for directly reading image data stored in a storage medium such as a memory card to print it, or receiving image data from a digital camera to print it.

In FIG. 1, a main body constituting an outer shell of the photodirect printer 1000 of the embodiment has exterior members of a lower case 1001, an upper case 1002, an access cover 1003, and an eject tray 1004. Additionally, the lower and upper cases 1001 and 1002 roughly form lower and upper halves of the printer 1000 respectively, both cases are combined to form a hollow structure having a housing space to house each later-described mechanism inside, and openings are respectively formed in the upper and front parts thereof. Further, one end of the eject tray 1004 is rotatably held on the lower case 1001, and rotated to open/close the opening formed in the front part of the lower case 1001. Accordingly, when a recording operation is carried but, the eject tray 1004 is rotated to the front side to open the opening, whereby recording sheets can be ejected therefrom, and the ejected recording sheets can be sequentially loaded. Additionally, the eject tray 1004 houses two auxiliary trays 1004*a* and 1004*b*, and each tray is pulled to a near side to increase/decrease a supporting area of a sheet by three stages when necessary.

One end of the access cover 1003 is rotatably held on the upper case 1002 to open/close the opening formed in the upper surface. This access cartridge 1003 is opened to enable replacement of a recording head cartridge (not shown), an ink tank (not shown) or the like housed inside the main body. Incidentally, though not shown, when the access cover 1003 is opened, a projection formed on its backside rotates a cover opening/closing lever. A rotational position of the lever is detected by a micro switch or the like so that an opened/closed state of the access cover can be detected.

Additionally, a power supply key 1005 is disposed to be depressed on the upper surface of the upper case 1002. On the right side of the upper case 1002, an operation panel 1010, provided with a liquid crystal display 1006, various key switches, etc., is disposed. A structure of this operation panel 1010 will be described later in detail by referring to FIG. 3. A reference numeral 1007 denotes an automatic feeder for automatically feeding the recording sheets into the printer main body. A reference numeral 1008 denotes a sheet gap selection lever for adjusting a gap between the recording head and the recording sheet. A reference numeral 1009 denotes a card slot into which an adaptor capable of loading a memory card is inserted. Through this adaptor, image data stored in the memory card can be directly fetched to be printed. For the memory card (PC), for example, a compact flash memory, a smart medium, a memory stick, etc., are available. A reference numeral 1011 denotes a viewer (liquid crystal display), which can be attached to/detached from the printer main body, and used for displaying an image or an index image of each frame when an image to be printed is searched among images stored in the PC card. A reference numeral 1012 denotes a terminal for connecting a later-described digital camera, and 1013, a USB connector for connecting a personal computer (PC).

Figure 2:
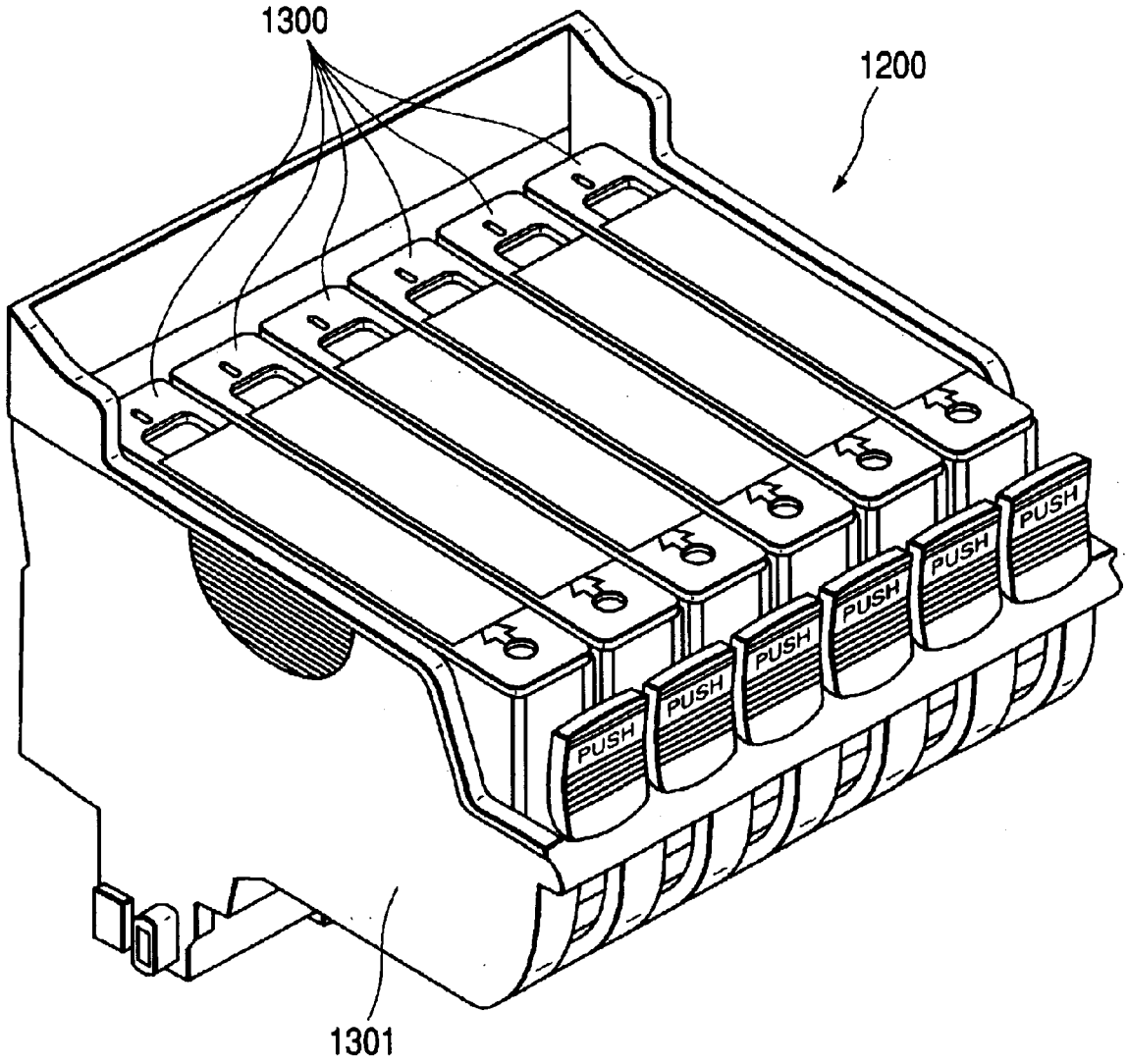
FIG. 2 is a schematic perspective view showing a constitution of a recording head.

FIG. 2 is an appearance perspective view showing a constitution of the recording head of the photodirect printer 1000 of the embodiment. As shown in FIG. 2, a recording head cartridge 1200 of the embodiment has an ink tank 1300 for storing ink, and a recording head 1301 for discharging ink supplied from the ink tank 1300 from a nozzle in accordance with recording information. The recording head 1301 employs a so-called cartridge system where it is detachably loaded on a carriage 1102. In recording, the recording head cartridge 1200 is reciprocated along a carriage axis to be scanned, and accordingly a color image is recorded on the recording sheet. In the recording head cartridge 1301 shown here, in order to enable high image quality photographic color recording, ink tanks, for example, ink tanks of black, light cyan (LC), light magenta (LM), cyan, magenta, and yellow, are prepared independently of one another, and each can be attached to/detached from the recording head 1301.

The embodiment is described by way of case where the aforementioned six color ink tanks are used. However, the present invention is not limited to the case of using the six color ink tanks. For example, it may be applied to an ink jet printer for executing recording by using ink of four colors, black, cyan, magenta, and yellow. In this case, ink tanks of four colors independent of one another may be attached to/detached from the recording head 1301.

Figure 3:
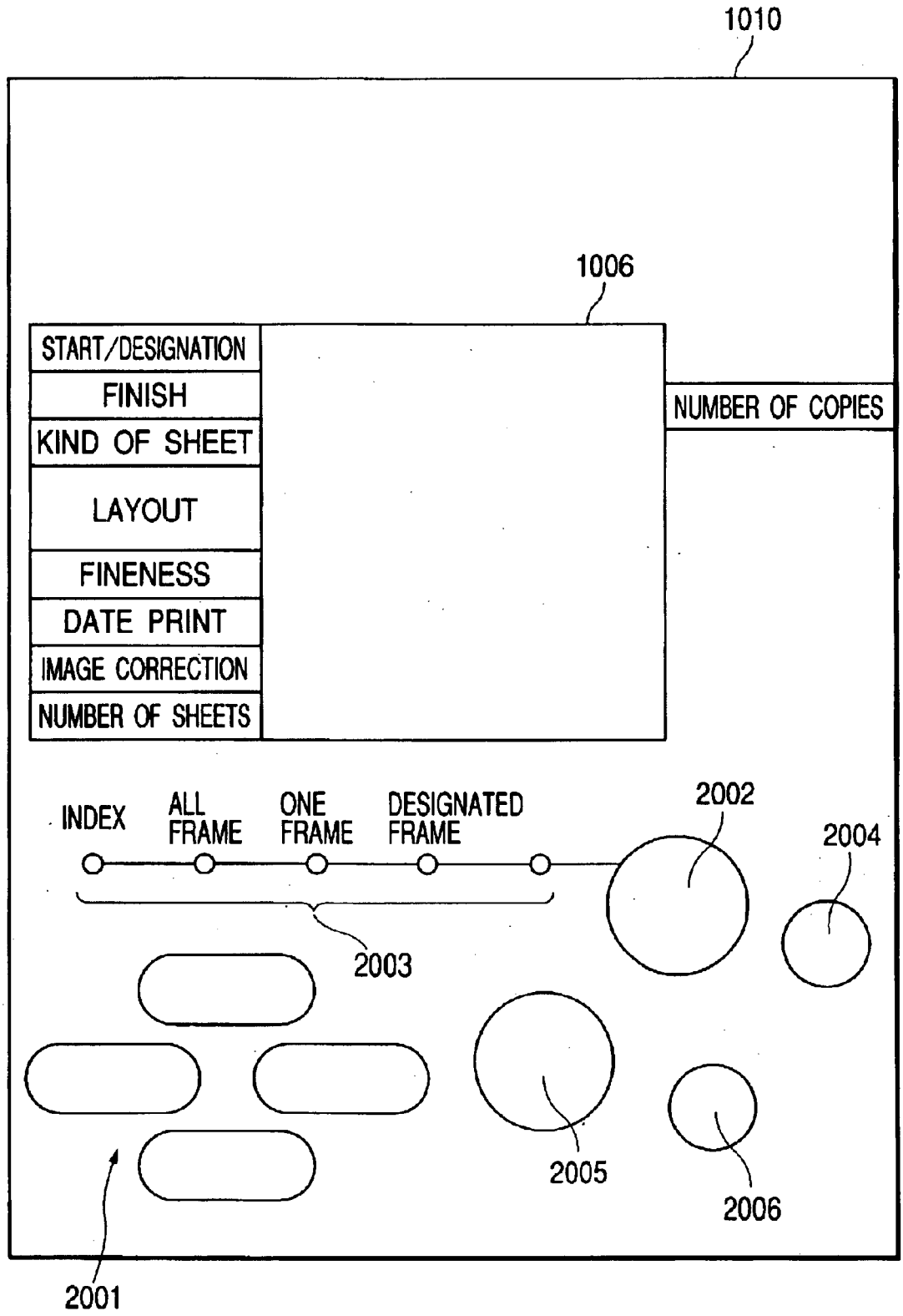
FIG. 3 is a schematic view of an operation panel.

FIG. 3 is a schematic view of the operation panel 1010 of the embodiment. In the drawing, on the liquid crystal display 1006, menu items for setting various data regarding items printed left and right are displayed. As items to be displayed, there are a head photo number in a range to be printed, a designated frame number (start/designation), a last photo number in a range to stopped for printing (finish), the number of prints (number of copies), a kind of sheet (recording sheet) used for printing (kind of sheet), setting of the number of photos to be printed on one sheet (layout), designation of printing fineness (fineness), designation as to printing of photographing date (date of print), designation as to correction printing of photo (image correction), displaying of the number of sheets necessary for printing (number of sheets), etc. Each of these items is selected or designated by using a cursor key 2001. A reference numeral 2002 denotes a mode key. Each depressing of this key 2002 enables switching of a kind of printing (index printing, all frame printing, one frame printing or the like) and, in accordance with the switching, a corresponding LED of an LED group 2003 is lit. A reference numeral 2004 denotes a maintenance key for printer maintenance, such as cleaning of the recording head 1301. A reference numeral 2005 denotes a printing start key depressed to instruct a start of printing or establish maintenance setting. A reference numeral 2006 denotes a printing stop key depressed to instruct stopping of printing or maintenance.

Figure 4:
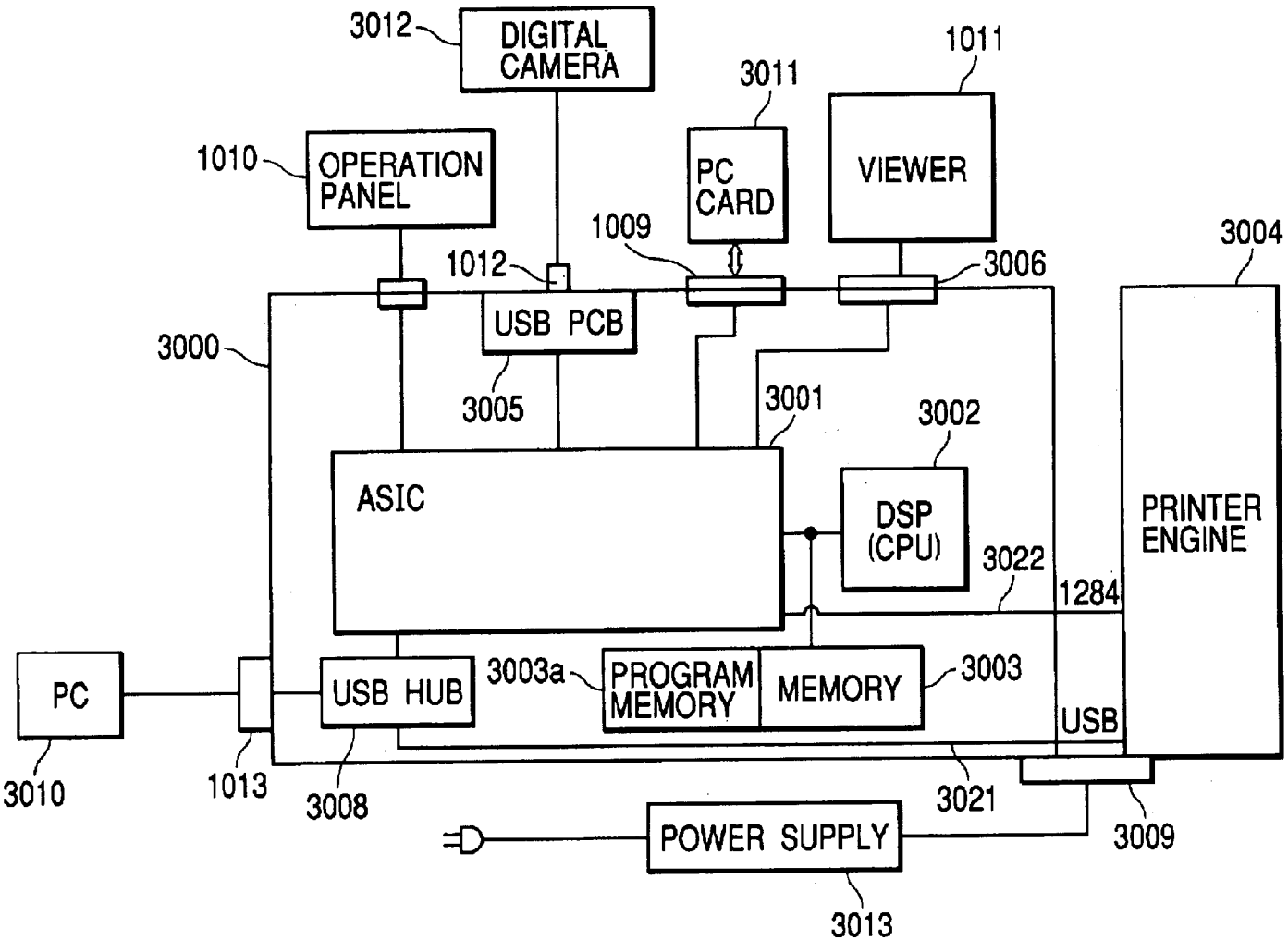
FIG. 4 is a view explaining a constitution of main sections regarding control of the photodirect printer.

By referring to FIG. 4, description will be made of a constitution of main sections regarding control of the photodirect printer 1000 of the embodiment. In FIG. 4, portions similar to those of the previous drawings are denoted by similar reference numerals, and description thereof will be omitted.

In FIG. 4, a reference numeral 3000 denotes a control unit (control substrate). A reference numeral 3001 denotes an ASIC (dedicated custom LSI), which constitution will be described later in detail by referring to a block diagram of FIG. 5. A reference numeral 3002 denotes a digital signal processor (DSP, e.g., DSP-C6211 by US Tex. Instrument Inc.), which has a CPU inside, and executes various controls, image processing such as conversion of a luminance signal (RGB) into a concentration signal (CMYK), scaling, gamma conversion, error diffusion or the like, etc. A reference numeral 3003 denotes a memory, which has a program memory 3003*a* for storing a CPU control program of the DSP 3002, a RAM area for storing a program of execution time, and a memory area functioning as a work memory to store image data or the like. A reference numeral 3004 denotes a printer engine. In the described case, a printer engine of an ink jet printer for printing a color image by using a plurality of, color inks is loaded. A reference numeral 3005 denotes a USB bus connector as a port for connecting a digital camera 3012. A reference numeral 3006 denotes a connector for connecting the viewer 1011. A reference numeral 3008 denotes a USB bus hub, which directly passes data from the PC 3010 when the printer 1000 executes printing based on image data from the PC 3010, and outputs the data through the USB bus 3021 to the printer engine 3004. Accordingly, the connected PC 3010 can directly transfer data or signals with the printer engine 3004 to execute printing (functions as a general PC printer). A reference numeral 3009 denotes a power supply connector to which DC voltage converted from a commercial AC is entered by a power supply 3013. The PC 3011 is a general personal computer, a reference numeral 3011 is the aforementioned memory card (PC card), and 3012 a digital camera.

Incidentally, the transfer of signals between the control unit 3000 and the printer engine 3004 is executed through the USB bus or an IEEE1284 bus 3022.

Figure 5:
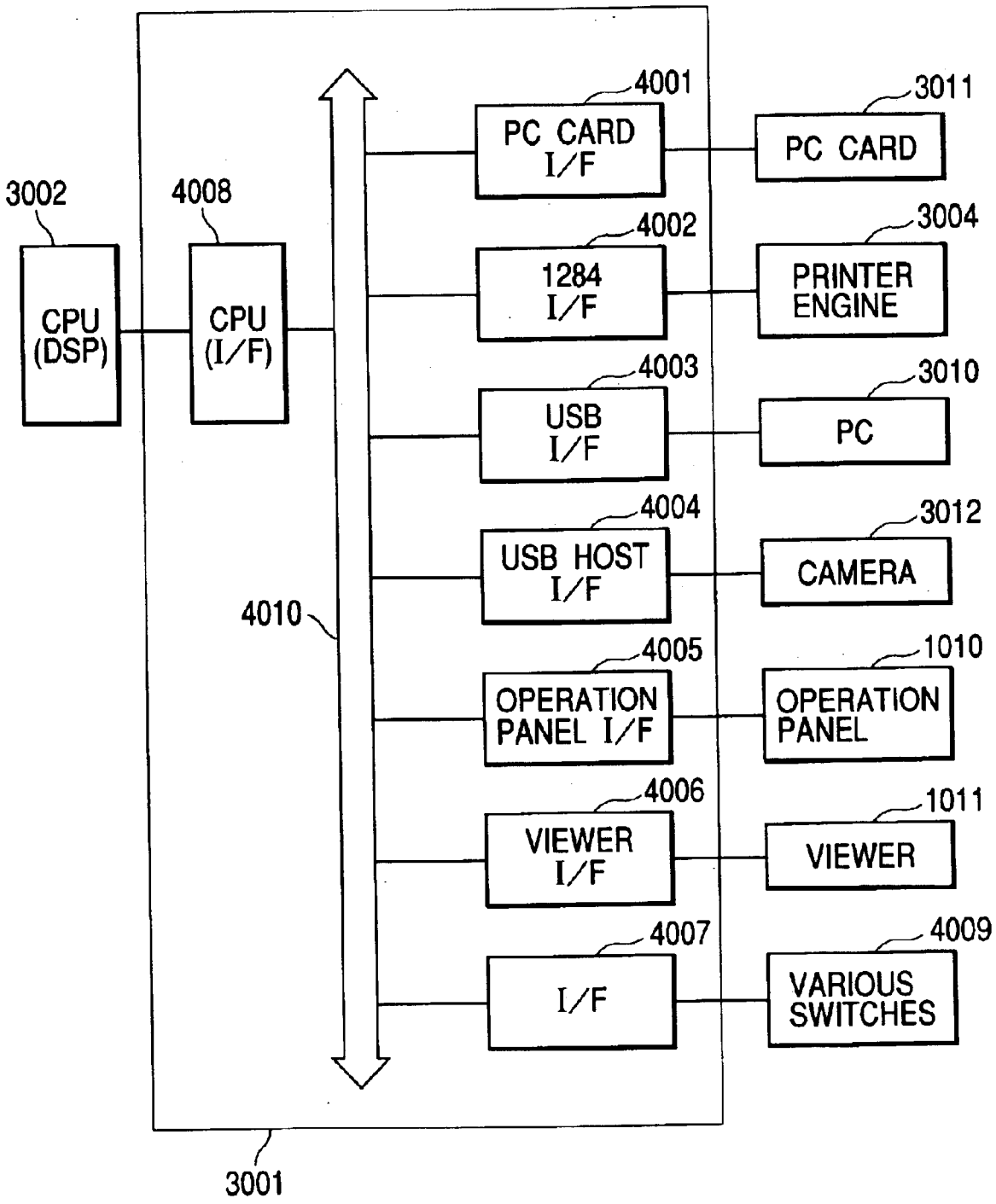
FIG. 5 is a block diagram showing a constitution of an ASIC.

FIG. 5 is a block diagram showing a constitution of the ASIC 3001 of FIG. 4. Also in FIG. 5, portions similar to those of the previous drawings are denoted by similar reference numerals, and description thereof will be omitted.

A reference numeral 4001 denotes a PC card interface for reading image data stored in the loaded PC card 3011, or writing data in the PC card 3011. A reference numeral 4002 denotes an IEEE1284 interface for transferring data with the printer engine 3004. This IEEE1284 interface is a bus used for printing image data stored in the storage medium of the digital camera 3012 or the PC card 3011. A reference numeral 4003 denotes a USB interface for transferring data with the PC 3010. A reference numeral 4004 denotes a USB host interface for transferring data with the digital camera 3012. A reference numeral 4005 denotes an operation panel interface for entering various operation signals from the operation panel, outputting display data to the display 1006, etc. A reference numeral 4006 denotes a viewer interface for controlling displaying of image data to the viewer 1011. A reference numeral 4007 denotes an interface for controlling interfacing between various switches and an LED or the like 4009. A reference numeral 4008 is a CPU interface for controlling transfer of data with the DSP 3002. A reference numeral 4010 is an internal bus (ASIC bus) for connecting these sections.

Figure 6:
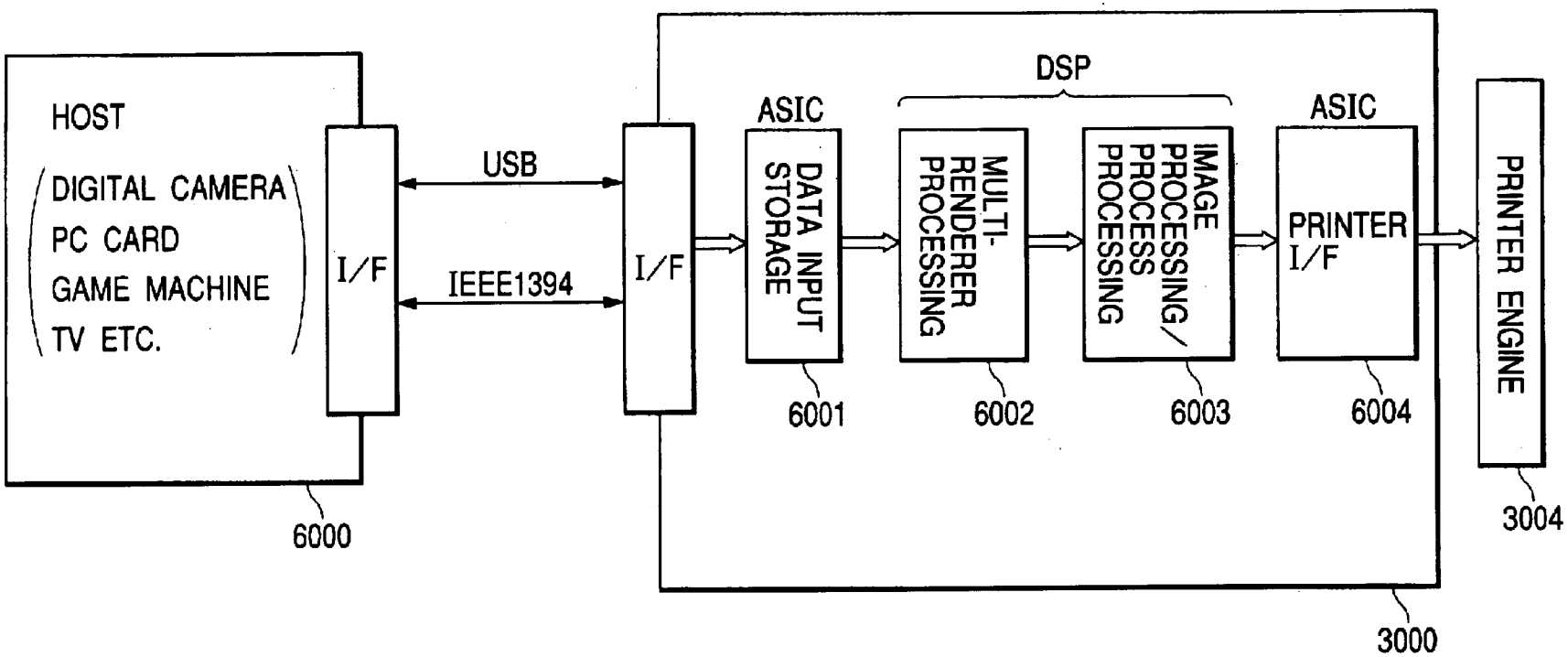
FIG. 6 is a functional block diagram showing a functional constitution regarding an interface and image processing control of the photodirect printer.

FIG. 6 is a functional block diagram showing a functional constitution regarding an interface and image processing control of the photodirect printer 1000 of the embodiment. Also in FIG. 6, portions similar to those of the previous drawings are denoted by similar reference numerals, and description thereof will be omitted.

A reference numeral 6000 denotes a host (image data source) seen from the photodirect printer 1000. This host 6000 includes the aforementioned PC 3010 which is a host computer, the digital camera 3012, the PC card 3011, a not-shown game machine, a TV, etc. Such a host 6000 is connected through a wire interface such as a USB bus, IEEE1294 or IEEE1394. In addition, a radio interface such as a Bluetooth® interface may be used.

The functions of the aforementioned control substrate 3000 include data input and storage processing unit 6001 realized by the ASIC 3001, a printer interface 6002 for outputting print data to the printer engine 3004, multi-renderer processing 6002 executed by the DSP 3002, and image processing/process processing unit 6003.

First, image data is read from the host 6000 through the IF, and stored in the data input storage unit 6001. The stored data is subjected to multi-renderer processing by the DSP 3002 to be restored, and converted into data to be processed by the image processing/process processing unit 6003. At the image processing/process processing unit 6003, processing similar to size conversion/color conversion/quantization executed by a printer driver on the host PC is carried out. Color processing here includes conversion of RGB into R', G' and B' for correcting deviation between color space of an original image from output color space of the printer, conversion of R', G' and B' into CMYK which is color conversion to a color material component of the printer, general color conversion such as output gamma correction, and image correction processing for properly representing a color of an image photographed by the digital camera. Subsequently, the print data is sent through the IF 6004 to the printer engine 3004. No specific mention is made of an operation of the printer engine here. However, various controls such as control of a main body motor, and transfer of data to the recording head are carried out by a well-known method to record the image in the storage medium.

The photodirect (PD) printer to which the present invention is applied has schematically been described. A characteristic point is that the processing is executed by using the digital signal processor (DSP). Generally, the DSP is good at product sum calculation, and especially the DSP of a high-function type incorporating many arithmetic elements similar to those used by the embodiment can advantageously execute parallel processing such as a plurality of product sum calculations. Especially in the normal processor, the DSP of the embodiment is suitable for calculation such as color processing or quantization which imposes a heavy load during direct printing.

At the controller of the PD printer of the embodiment, the DSP is used to execute main processing by software. However, there is a hardware unit for executing such processing, and a controller for executing a part of the processing by software and the rest by hardware has no effect on the main object of the present invention. However, while the increase of hardware processing can achieve a higher speed compared with software processing, expandability to add functions and flexibility are lower compared with the software processing. By using the DSP of the high-function type of the present invention, it is possible to realize a high-speed system excellent in expandability and flexibility.

Especially, in the process of problem recognition which has led to the present invention, in the case of using the DSP of the high-function type, since other processing such as image processing is executed at a relatively high speed, it is clear that one processing occupying a large proportion of processing time is time of accessing the storage medium such as a PC card. Thus, it is now recognized that when the present invention is applied to the PD printer using the DSP of the high-function type similar to that of the embodiment, performance improvement can made more clearly.

By way of embodiments, description will be made of an apparatus and a method for image processing, which can shorten a waiting time until a start of printing by executing minimum required image analysis and parameter calculation before the start of actual printing to start printing, and executing other image analysis and parameter calculation by necessary timings during the printing.

Figure 7:
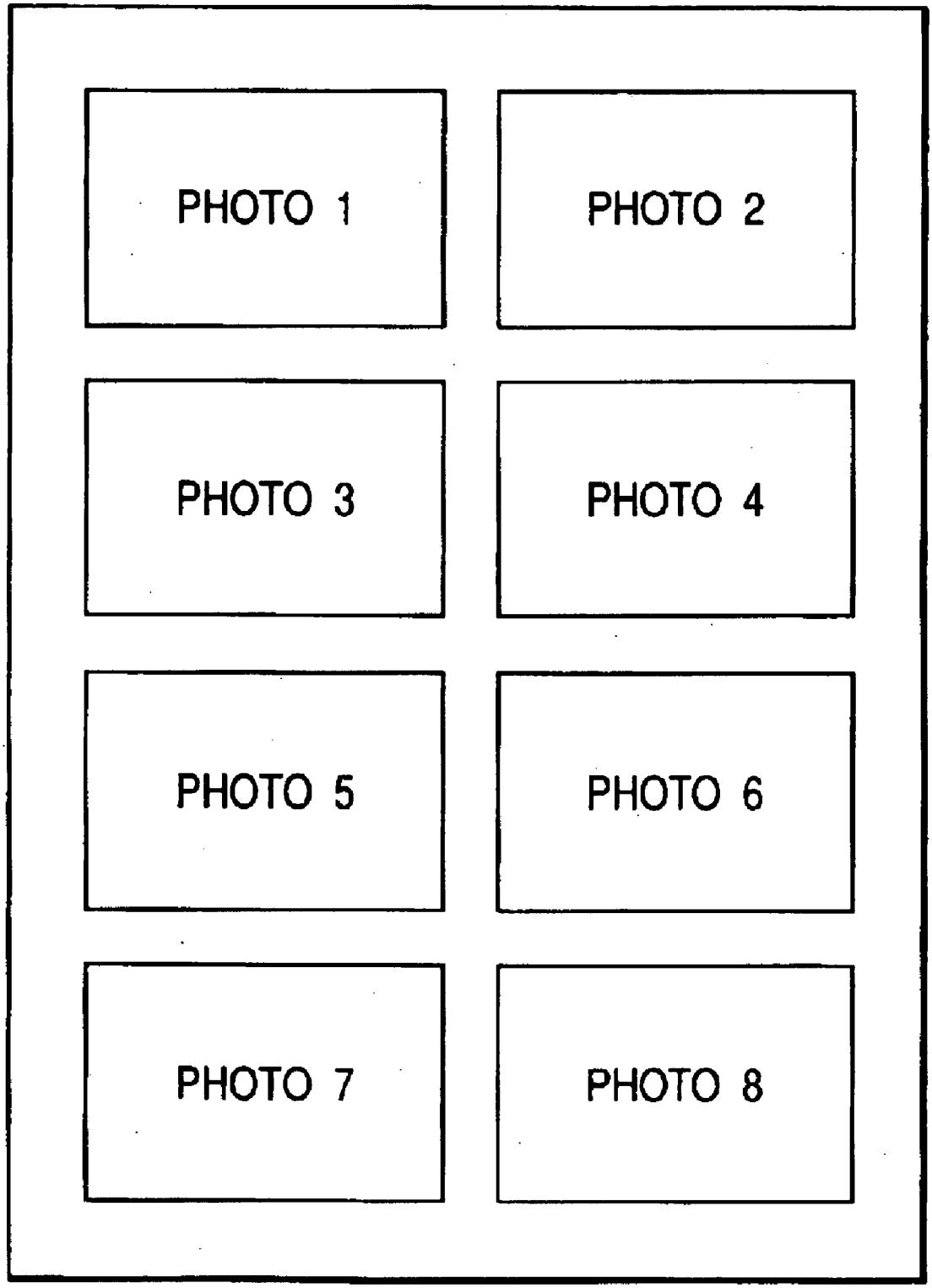
FIG. 7 is a view showing an example of an output image and a layout according to a first embodiment.

FIG. 7 shows a layout example of an image to be printed and a page according to the embodiment. In the page, there are eight different photos, Photo 1 to Photo 8 and, individually for the respective photos, optimal image correction is made regarding characteristics of respective photo images.

For the image correction executed in the embodiment, a well-known method may be used.

For example, a brightness histogram of an image is obtained beforehand and, based on a color difference or the like between or for a highlight point and a shadow point, color seepage/contrast/saturation is corrected. In the embodiment, all of these are corrected, but at least one may be executed. In any case, before creation of print data of a photo image, it is necessary to analyze image information once to create a parameter for the image correction.

Figure 8:
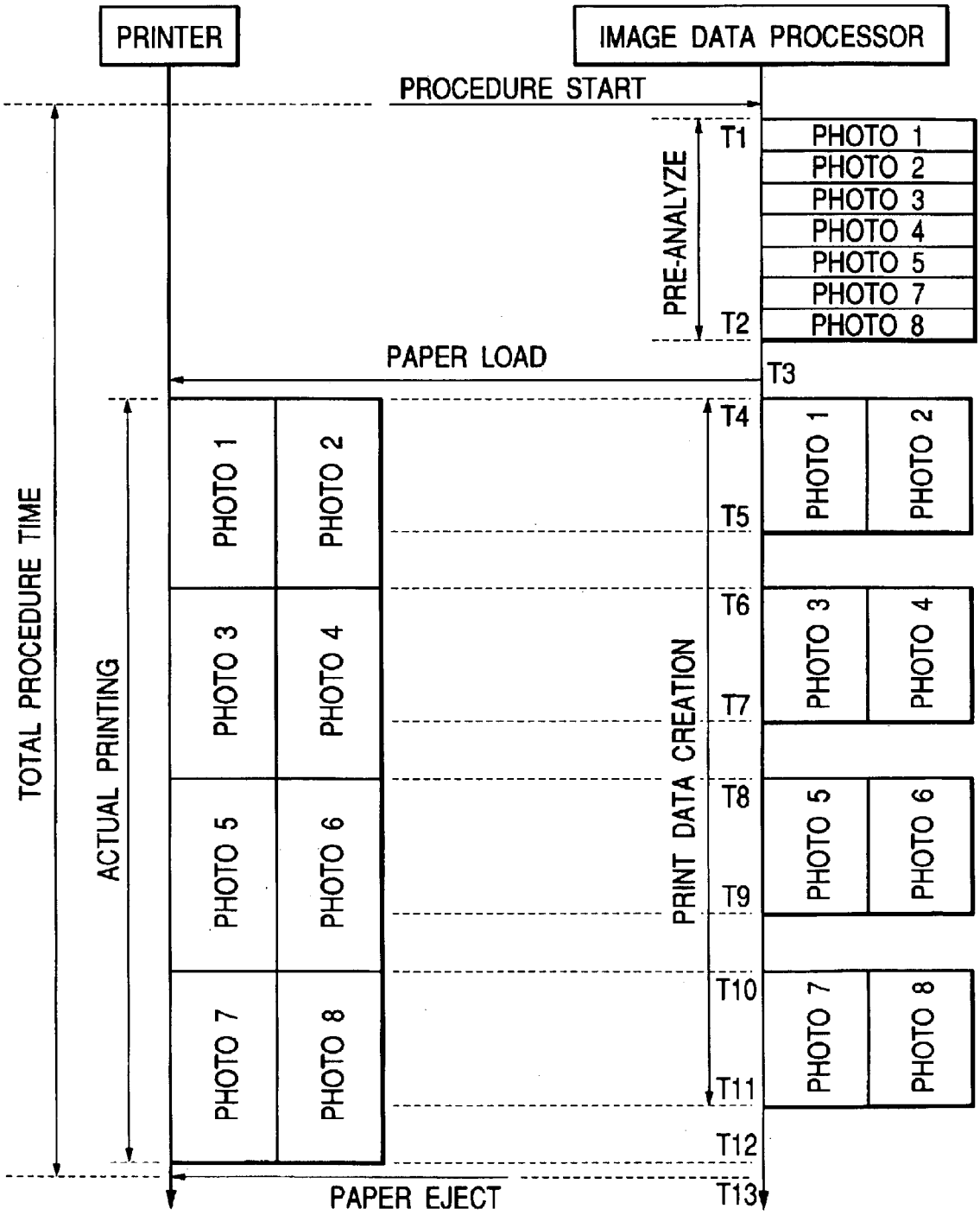
FIG. 8 is a view showing a relation between each processing of an image data processor and a printer and time according to a conventional example.

FIG. 8 shows a transition of each processing and time in an actual photo output of a conventional example. A right side of FIG. 8 shows a processing content of an image data processor for each time, and a left side thereof shows a processing content of a printer for each time.

An arrow of a downward direction indicates a time base. T1 to T13 denote the following timings.

T1: start of image analysis and correction parameter calculation of Photos 1 to 8
T2: end of image analysis and correction parameter calculation of Photos 1 to 8
T3: instruction of paper feeding from image data processor, and start of printer paper feeding
T4: start of image print data creation and actual printing (end of printer paper feeding) of Photos 1 and 2
T5: end of image print data creation of Photos 1 and 2
T6: start of image print data creation and actual printing (end of actual printing of Photos 1 and 2) of Photos 3 and 4
T7: End of image print data creation of Photos 3 and 4
T8: start of image print data creation and actual printing (end of actual printing of Photos 3 and 4) of Photos 5 and 6
T9: end of image print data creation of Photos 5 and 6
T10: start of image print data creation and actual printing (end of actual printing of Photos 5 and 6) of Photos 7 and 8
T11: end of image print data creation of Photos 7 and 8
T12: end of actual printing of Photos 7 and 8
T13: printer side paper ejection FIG. 8 shows an example where a print data creation speed at the image data processor is relatively higher compared with an actual printing speed of the printer. Thus, by three timings between T5 and T6, between T7 and T8 and between T9 and T10, the image data processor waits for the end of the actual printing of the printer.

Figure 9:
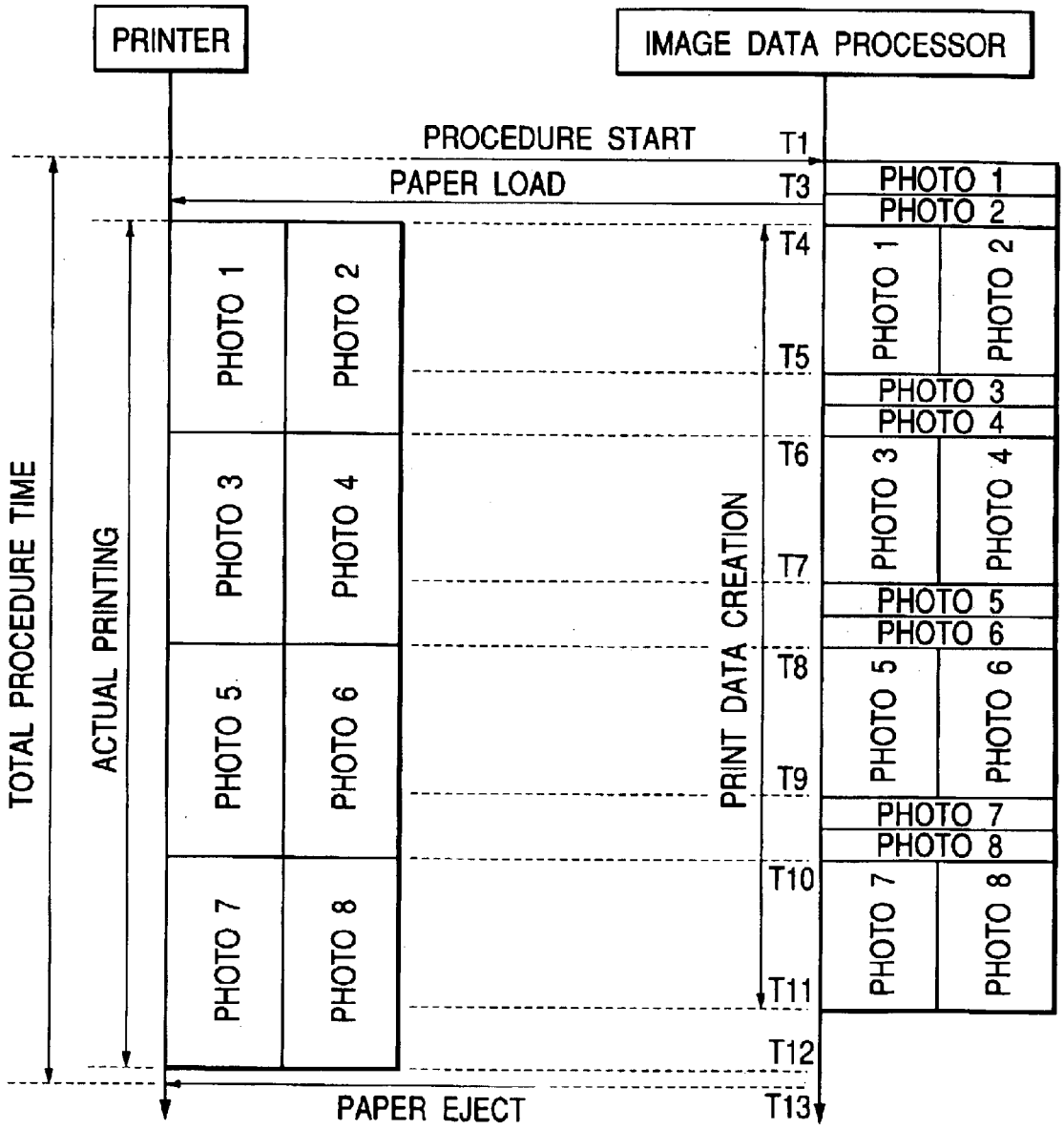
FIG. 9 is a view showing a relation between each processing of an image data processor and a printer and time according to the present invention.

FIG. 9 shows a transition of each processing and time in an actual photo output of the present invention. A right side of FIG. 9 shows a processing content of an image data processor for each time, and a left side thereof shows a processing content of a printer for each time.

In short, in accordance with decided correction amounts of image data arranged in a main scanning direction, the correcting means corrects a plurality of images arranged in the main scanning direction, and the image data corrected by the correcting means are outputted to the printer.

That is, if a short side of FIG. 7 is a main scanning direction, from a point of time when correction amounts are decided for two, Photos 1 and 2, correction processing for the two images and output to the printer are started. Then, while the printer prints the two images, the DSP starts analysis of Photos 3 and 4 to be outputted next.

Incidentally, this processing is effective for the printer for dot-sequentially outputting images.

While the printer prints the image data outputted by the outputting means, the correction amount deciding means starts processing for deciding correction amounts of images to be outputted next.

T1 to T13 denote the following timings.

T1: start of image analysis and correction parameter calculation of Photos 1 and 2

T3: instruction of paper feeding from image data processor, and start of printer paper feeding T4: end of image analysis and correction parameter calculation of Photos 1 and 2, and start of image print data creation and actual printing (end of printer paper feeding) of Photos 1 and 2

T5: end of image print data creation of Photos 1 and 2, and start of image analysis and correction parameter calculation of Photos 3 and 4

T6: end of image analysis and correction parameter calculation of Photos 3 and 4, and start of image print data creation and actual printing (end of actual printing of Photos 1 and 2) of Photos 3 and 4

T7: end of image print data creation of Photos 3 and 4, and start of image analysis and correction parameter calculation of Photos 5 and 6

T8: end of image analysis and correction parameter calculation of Photos 5 and 6, and start of image print data creation and actual printing (end of actual printing of Photos 3 and 4) of Photos 5 and 6

T9: end of image print data creation of Photos 5 and 6, and start of image analysis and correction parameter calculation of Photos 7 and 8

T10: end of image analysis and correction parameter calculation of Photos 7 and 8, and start of image print data creation and actual printing (end of actual printing of Photos 5 and 6) of Photos 7 and 8

T11: end of image print data creation of Photos 7 and 8

T12: end of actual printing of Photos 7 and 8

T13: printer side paper ejection.

In FIG. 9, compared with FIG. 8, since by three timings between T5 and T6, between T7 and T8 and between T9 and T10 analysis of subsequent photo images and correction parameter creation are executed, the time of waiting of the image data processor for the end of the actual printing of the printer is shorter by a corresponding amount.

By referring to FIG. 9, description has been made of the ideal case of a relation of analysis & correction parameter calculation time=(actual printing time−print data creation time). However, for example, in the case of analysis & correction parameter calculation time>(actual printing time−print data creating time), or in the case of analysis & correction parameter calculation time<(actual printing time−print data creation time), the time of waiting of the image data processor for the end of actual printing of the printer is shorter by an amount equal to a shorter time of the right and left sides of the equation. The printer is a printer on which a memory card can be loaded. While the printer prints the image data outputted by the outputting means, an image to be outputted next, i.e., an image arranged in the main scanning direction, is read to start image analysis, whereby the time including reading of the image data can be shortened.

Additionally, since the time of T1 to T2 of FIG. 8 is shorter when a high-speed processing element similar to the aforementioned DSP is applied to the present invention, it is easily considered that effects of the present invention are reduced. Actually, however, the effects are increased. The reason is as follows.

In an actual type of usage, the aforementioned analysis & correction parameter calculation time (a) is actually (a)= image file access time+actual analysis & correction parameter calculation time, and the file access time is decided by file control hardware restrictions more than a processing speed of the CPU. For example, in the case of an image file stored in a card medium such as a compact flat (CF) card, a processing speed of a CF card controller, a standard of the CF card and the like define an upper limit of an actual processing speed.

Accordingly, the higher the speed of actual image processing executed by using the DSP for the photodirect printer, the closer to (a)=image file access time.

Thus, the time (b) actually shortened by the present invention is (b)=min ((a), (actual printing time−print data creation time)) and, when higher-speed processing is executed, the print data creation time is shortened to increase (actual printing time−print data creation time), whereby effects are increased.

In the system where normally the print data creation speed of the image data processor is relatively lower than the actual printing speed of the printer and the printer side waits for the processing of the image data processor, the time reduction effect of the entire printing time by applying the present invention cannot be obtained. However, as clearly understood from comparison of FIGS. 8 and 9, the time T1 to T2 until paper feeding is extremely short. A lower image processing speed reduces the time more, which is more effective.

Additionally, there is another effect that image correction parameters to be simultaneously held are arranged side by side in a horizontal direction to improve performance by the number of images to be simultaneously printed. For example, in the case of eight image layout of FIG. 8, only correction parameters for two images need to be held, and a memory amount to be occupied at a time is only ¼ of that of the eight images of the conventional example.

Figure 10:
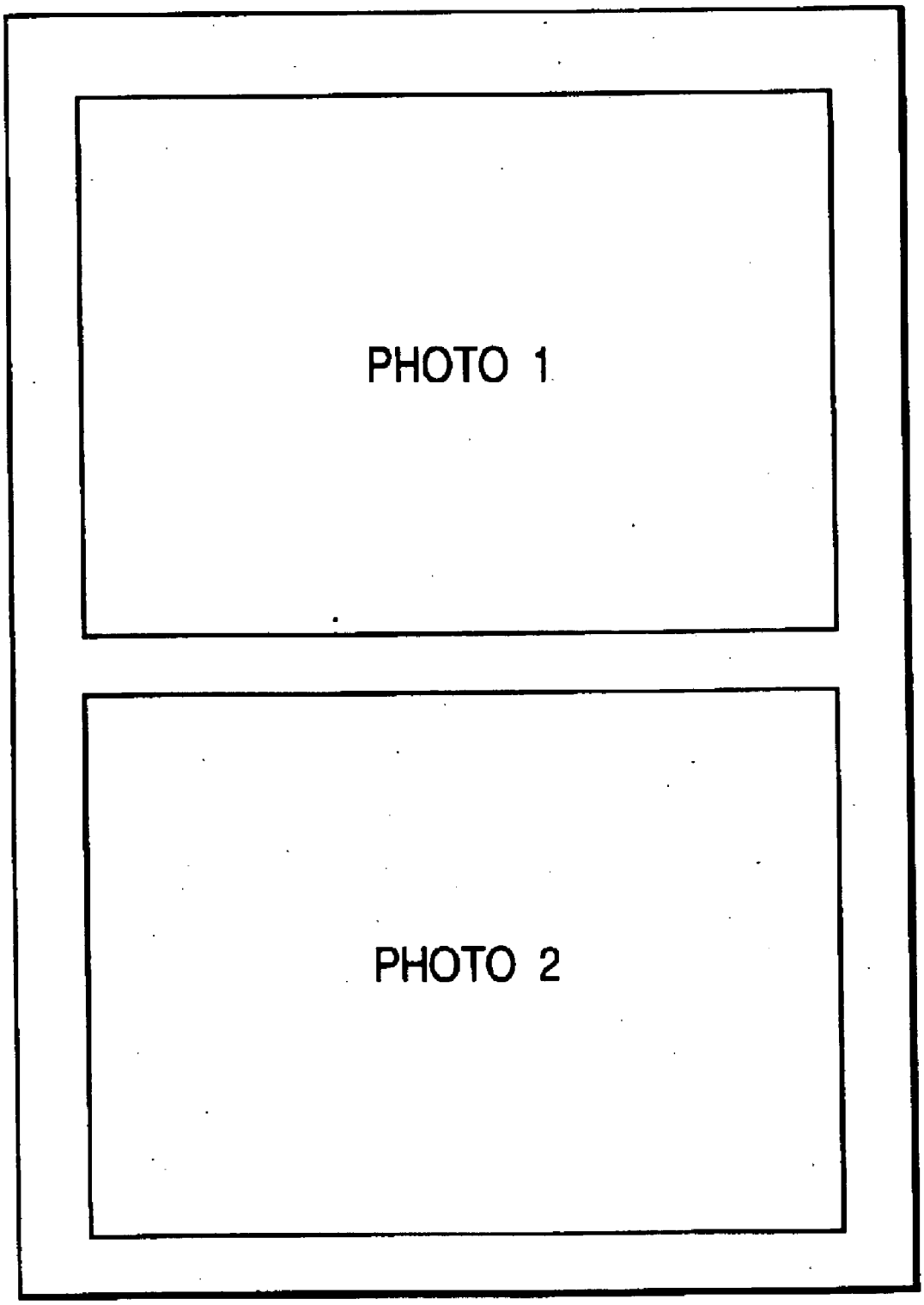
FIG. 10 is a view showing another example of an output image and a layout according to the first embodiment.

The embodiment has been described by way of example where the eight photos are printed on one page. Needless to say, however, the present invention can be applied to printing of 2 image layout of FIG. 10 or other layout/number of images.

The description has been made by taking the example of the photodirect printer. However, a similar operation may be carried out on a printer driver operated on the PC or by using other image processing means.

The description has been made by taking the example of processing using the DSP. However, other processors or ASIC may be used.

The present invention may be applied to a system constituted of a plurality of equipments (e.g., host computer, interface device, reader, and printer), or a device constituted of one equipment (e.g., copying machine, or facsimile).

In order to operate various devices to realize the aforementioned functions of the embodiment, a software program code for realizing the functions of the embodiment is supplied to a computer in a device or a system connected to various devices, and the computer (CPU or MPU) of the system or the device operates various devices in accordance with a stored program. This implementation is also within the scope of the present invention.

Additionally in this case, the software program code itself realizes the aforementioned functions of the embodiment, and the program code itself, means for supplying the program code to the computer, e.g., a storage medium storing the program code, constitute the present invention.

As the storage medium storing the program code, e.g., a floppy disk, a hard disk, an optical disk, a magneto-optical disk, a CD-ROM, a magnetic tape, a nonvolatile memory card, a ROM or the like can be used.

Not only does the computer execute the supplied program code to realize the functions of the embodiment, but also the program code works together with an operating system (OS) operating on the computer or other application software to realize the functions of the embodiment. Needless to say, the program code in this case is included in the embodiment of the present invention.

Furthermore, the supplied program code is stored in the memory provided in the function expansion board of the computer or the function expansion unit connected to the computer, and then the CPU or the like provided in the function expansion board or the function storage unit executes a part or all of actual processing based on the instruction of the program code, whereby the functions of the embodiment are realized. Needless to say, this case is also included in the present invention.

As described above, by the application of the present invention, minimum required image analysis and parameter calculation are executed before the start of actual printing to start printing, and other image analysis and parameter calculation are executed by necessary timings during the printing. Therefore, it is possible to realize an image processing apparatus and an image processing method capable of shortening a waiting time until the start of printing, a time of entire printing, a waiting time of the image data processor, etc.

The present invention is not limited to the aforementioned embodiments, and various changes and modifications can be made within the scope of the appended claims.

What is claimed is:

1. An image processing apparatus comprising:

correction amount determining means for determining an individual correction amount for each of a plurality of image data; and correcting means for correcting the image data based on the individual correction amounts, wherein in an uncompleted state of determining the correction amounts of all the plurality of image data by the correction amount deciding means, the correcting means executes correction for the image data based on the determined individual correction amounts.

2. The image processing apparatus according to claim 1, wherein the correction amount determining means comprises analyzing means for individually analyzing contents of the image data.

3. The image processing apparatus according to claim 2, wherein the analyzing means analyzes at least one of a brightness histogram of the image data and a color difference for a highlight point and a shadow point.

4. The image processing apparatus according to claim 1, further comprising outputting means for outputting the image data corrected by the correcting means to a printer.

5. The image processing apparatus according to claim 4, wherein the printer dot-sequentially prints the image data, the correcting means corrects images arranged in a main scanning direction in accordance with the determined correction amounts of the image data arranged in the main scanning direction, the outputting means outputs the image data corrected by the correcting means and, while the printer prints the image data outputted by the outputting means, the correction amount determining means starts processing for determining a correction amount of an image to be outputted next.

6. The image processing apparatus according to claim 5, wherein the printer is a printer on which a memory card is loaded, and reading means is provided to read, while the printer prints the image data outputted by the outputting means, an image to be outputted next, i.e., an image arranged in the main scanning direction.

7. The image processing apparatus according to claim 4, wherein the printer prints the plurality of images on one sheet.

8. The image processing apparatus according to claim 4, wherein the printer is a printer of an ink jet system.

9. The image processing apparatus according to claim 1, wherein the correction amount determining means comprises a digital signal processor (DSP).

10. An image processing method comprising:

a correction amount determining step of determining an individual correction amount for each of a plurality of image data; and a correcting step of correcting the image data based on the individual correction amount, wherein in an uncompleted state of determining the correction amounts of all the plurality of image data in the correction amount determining step, the correcting step executes correction for the image data based on the determined individual correction amounts.

11. The image processing method according to claim 10, wherein the correction amount determining step comprises an analyzing step of individually analyzing contents of the image data.

12. The image processing method according to claim 11, wherein the analyzing step analyzes at least one of a brightness histogram of the image data and a color difference for a highlight point and a shadow point.

13. The image processing method according to claim 10, further comprising an outputting step of outputting the image data corrected in the correcting step to a printer.

14. The image processing method according to claim 13, wherein the printer dot-sequentially prints the image data, the correcting step corrects images arranged in a main scanning direction in accordance with the determined correction amounts of the image data arranged in the main scanning direction, the outputting step outputs the image data corrected in the correcting step and, while the printer prints the image data outputted in the outputting step, the correction amount determining step starts processing for determining a correction amount of an image to be outputted next.

15. The image processing method according to claim 14, wherein the printer is a printer on which a memory card is loaded, and a reading step is provided to read, while the printer prints the image data outputted in the outputting step, an image to be outputted next, i.e., an image arranged in the main scanning direction.

16. The image processing method according to claim 13, wherein the printer prints the plurality of images on one sheet.

17. The image processing method according to claim 13, wherein the printer is a printer of an ink jet system.

18. The image processing method according to claim 10, wherein the correction amount determining step is controlled by a digital signal processor (DSP).

19. A storage medium for storing a program to cause a computer to execute an image processing method, the image processing method comprising:

a correction amount determining step of determining an individual correction amount for each of a plurality of image data; and a correcting step of correcting the image data based on the individual correction amounts, wherein in an uncompleted state of determining the correction amounts of all the plurality of image data in the correction amount determining step, the correcting step executes correction for the image data based on the determined individual correction amounts.

20. A program for causing a computer to execute an image processing method, the image processing method comprising:

a correction amount determining step of determining an individual correction amount for each of a plurality of image data; and a correcting step of correcting the image data based on the individual correction amounts, wherein in an uncompleted state of determining the correction amounts of all the plurality of image data in the correction amount determining step, the correcting step executes correction for the image data based on the determined individual correction amounts.

* * * * *

UNITED STATES PATENT AND TRADEMARK OFFICE

CERTIFICATE OF CORRECTION

PATENT NO. : 6,860,578 B2
DATED : March 1, 2005
INVENTOR(S) : Yamada et al.

It is certified that error appears in the above-identified patent and that said Letters Patent is hereby corrected as shown below:

Column 4,
Line 14, “of,” should read -- of --.

Column 5,
Line 67, “can” should read -- can be --.

Column 8,
Line 23, “(a)=image” should read -- (a)~image --.

Column 9,
Line 52, “deciding” should read -- determining --.

Signed and Sealed this

Twentieth Day of December, 2005

JON W. DUDAS
*Director of the United States Patent and Trademark Office*